United States Patent [19]
Smith

[11] Patent Number: 4,484,688
[45] Date of Patent: Nov. 27, 1984

[54] RECTANGULAR BARREL FOR AGING WHISKEY

[75] Inventor: Robert H. Smith, Louisville, Ky.

[73] Assignee: Robert Henry Smith Enterprises, Inc., Louisville, Ky.

[21] Appl. No.: 466,510

[22] Filed: Feb. 15, 1983

[51] Int. Cl.³ ..... B65D 6/00; B65D 6/28; B27H 5/04; B27H 5/08

[52] U.S. Cl. ..... 217/91; 144/353; 144/354; 217/12 R; 217/65; 217/88; 217/96

[58] Field of Search ..... 217/72, 17, 65, 88, 217/96, 91, 94, 12 R; 144/353, 354

[56] References Cited

U.S. PATENT DOCUMENTS

| | | | |
|---|---|---|---|
| 1,032,674 | 7/1912 | Holland | 217/65 X |
| 1,378,197 | 5/1921 | Schwab | 217/65 |
| 2,192,949 | 3/1940 | Wich | 217/17 X |
| 2,326,507 | 8/1943 | Welch, Jr. | 217/65 |
| 3,159,300 | 12/1964 | Coffey, Jr. | 217/65 |
| 3,456,827 | 7/1969 | Wakeem | 217/72 |
| 3,462,038 | 8/1969 | Morris | 217/72 |
| 4,093,099 | 6/1978 | Spooner | 217/72 |

FOREIGN PATENT DOCUMENTS

| | | | |
|---|---|---|---|
| 986333 | 7/1951 | France | 217/43 |
| 4256 | 2/1895 | Norway | 217/65 |

*Primary Examiner*—Allan N. Shoap
*Attorney, Agent, or Firm*—William R. Price

[57] ABSTRACT

A rectangular barrel-like structure having four wooden stave sides and two wooden stave head sections, joined together by specially designed triangular corner members. Each of the staves used in making the side walls and in making the head sections are of white oak and are of tongue-and-groove construction. Additionally, each of the staves utilized in the wall sections contains a croze at the top and at the bottom for snug engagement with the staves forming the head sections. Each of the triangular corner members is truncated at the junction of the leg and the base of the triangle so as to form a planar section equal in width to the width of the wall section stave. The truncated planar section contains a projecting tongue on one side for engagement with a complementary groove of a wall stave of one side section and a complementary groove on the other for engagement with a projecting tongue of one of the wall staves of the other wall section. A series of bumper members comprising wooden pieces each equal in length to the width of a wall section and of two corner members are tapered at each end and are arranged transversely across the wall section near the top and near the bottom. A metal tensioning strap of conventional construction encircles the four wooden bumpers and tension is applied so that pressure is applied to the wall sections and particularly to the apex of the triangular corner piece. The forces, therefore, when resolved, are at right angles so that the side wall staves are drawn into tight compressive tongue-and-groove engagement. No glues or bonding agents are employed whatsoever.

8 Claims, 6 Drawing Figures

RECTANGULAR BARREL FOR AGING WHISKEY

FIELD OF THE INVENTION

This invention relates to white oak barrels for use in aging whiskey. More particularly, this invention relates to white oak barrels of rectangular construction in which the staves are flat and planar rather than bowed, as with the prior-art round barrels. This invention, in a preferred embodiment, involves four wall sections and four triangular corner members of tongue-and-groove construction so that the pieces can be fitted together in watertight engagement. The head staves forming the head section are, in a preferred embodiment, of identical dimension to each other, but shorter than the wall staves. Again, the head staves are of tongue-and-groove construction. The rectangular barrel-like container of this invention can be made through mass production techniques and do not require the time and the skill required for the individually handmade round barrels of the prior art.

DESCRIPTION OF THE PRIOR ART

There has been a long-standing need in the whiskey distilling industry for a square barrel-like container for some years because the conventional prior-art round barrel requires a large storage space volume compared with the volume of its contents. A square barrel-like container will provide a space savings of about 40%. However, insofar as I am aware, despite the many proposals made in the past, rectangular or square barrels for the distilling industry have been unsuccessful because of the stringent requirements imposed thereon. As a result, even today, conventional round barrel-shaped containers, so well known in the art, have been and still are in use. These barrels, having a volume of approximately 50 gallons, are made of staves that are quarter-sawn from stave bolts of white oak. Customarily, body stave bolts are 39 inches long and head stave bolts are 23 inches long. Depending on the size of the tree, from 20 to 40 staves that have been cut on a barrel saw to provide the double-arch shape, are assembled to form the body of a barrel in a process which involves a large number of manual steps by skilled workmen. Flat head staves, having two planar surfaces, are secured in a croze and steel hoops of differing diameters are placed over the heads of the barrel and driven toward the center to compress the body staves together against the head staves. The joints between two staves in the prior round-barrel art have been of the butt joint variety. Because of the complex operation of the assembly and the fitting together of thirty or more staves by use of a metal ring, and subjecting the wood to steam and other treatments that are necessary to align the staves individually, it is very expensive to use tongue-and-groove body staves to make a smooth joint. Also, coopers have learned in the last 2000 years of making round barrels how to make a barrel sufficiently tight so that liquid does not drip from between the joints. Where leaks do appear after the barrel is filled, the leak can normally be stopped by tightening one or more of the hoops. Additionally, according to the round-barrel art, the staves must be quarter-sawn of white oak. It is well known in the art that quarter-sawn staves with the grain of the white oak free from sap are approximately one inch thick. Currently, whiskey is aged in barrels having a capacity of about 50 gallons that have stave lengths of about 36 inches and a head diameter of about 23 inches.

When wetted, a wood stave will expand a different amount longitudinally than laterally, and a flat head set into the croze of a rectangular body will expand at a different rate than the side parallel to the grain of the head. The difference is the source of leaks.

As can be seen, the hand cooperage of barrels is an old art practiced by skilled artisans. Unfortunately, in today's economy, it is essentially impossible to justify the expense of such fine craftsmanship. Applicant is aware of the patent to Morris, U.S. Pat. No. 3,462,038, which proposes a rectangular-shaped barrel. The Morris patent, however, disclosed a series of fingers for joining the staves together. These fingers, as for example in FIG. 2, were in the form of a rectangular piece, whereas in Fig. 7, the finger takes on ovoid shape, and in FIG. 9, a diamond shape with truncated ends. Additionally, Morris requires a bonding agent for holding the various staves together. Unfortunately, applicant's experience has been that whiskey is an extremely strong solvent for most bonding agents, and even if only a small part of the bonding agent is dissolved, it has an adverse effect on the taste of the whikey. Spooner, in U.S. Pat. No. 4,093,099, proposed a square-shaped box-like container which was pre-stressed, so as to hold the heads and the walls together. Wakeem, in U.S. Pat. No. 3,456,827, proposes wooden staves of general tongue-and-groove construction. Wakeem utilizes a generally rounded corner stave.

SUMMARY OF THE PRESENT INVENTION

According to the present invention, the wooden staves, both for the wall sections and head sections, can be mass produced with conventional woodworking machinery. It is not necessary, according to the present invention, to use quarter-sawn oak staves, although those can be used if desired. It is, of course, necessary to use white oak, which is later charred according to standard distilling practice. The present invention utilizes uniform, flat, planar staves having a tongue-and-groove construction which a croze located at the top end at the bottom. The wall staves fit into a complementary tongue or a complementary groove of a special triangular corner piece made with a planar section truncated at the junction of the leg of the triangle and the base of the triangle. Additionally, the triangular corner piece contains a croze at the top and at the bottom, near the planar surface formed by the base of the triangle. The head section is formed of uniform, flat, planar white oak staves, each having a tongue and a groove which are fitted together to form the head section. The two most lateral staves of the head section are shaped along one edge so as to fit snugly into the croze of the wall section, and are sawn at about 45° at the ends and shaped to fit into the croze of the two triangular corner members. Four wooden bumpers are arranged transversely across the side of the wall section and extending to the edge of the triangular corner piece near the top and bottom of the wall sections. Each of the wooden bumper members are tapered so that a metal strap encircling the four pieces can be tightened to apply pressure to the apex of the triangle, which force is translated into forces extending at right angles to cause compressive engagement of the corner members and the wall sections' tongue-and-groove to form a watertight engagement. Additionally, the bumper members provide room for the tines of forklift trucks to lift the rectangular or square barrels to be placed on pallets for storage or transport.

DESCRIPTION OF THE PREFERRED EMBODIMENT

Figure 1:
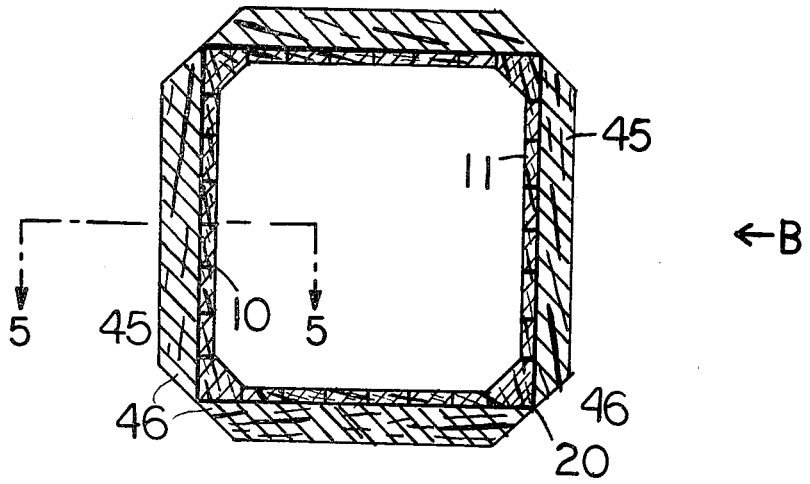
FIG. 1 is a sectional view of the assembled rectangular barrel of this invention.
Figure 2:
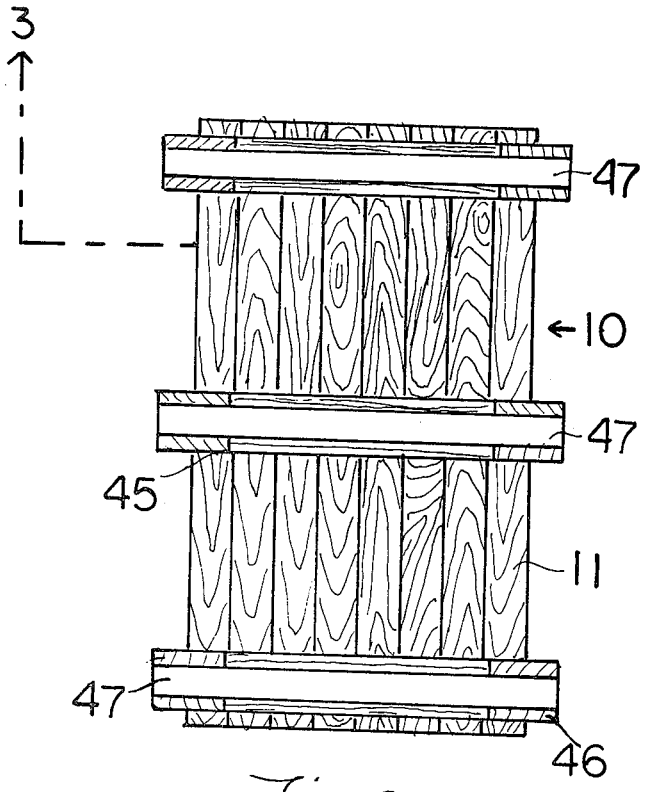
FIG. 2 is a side elevational view of the rectangular barrel of this invention.
Figure 3:
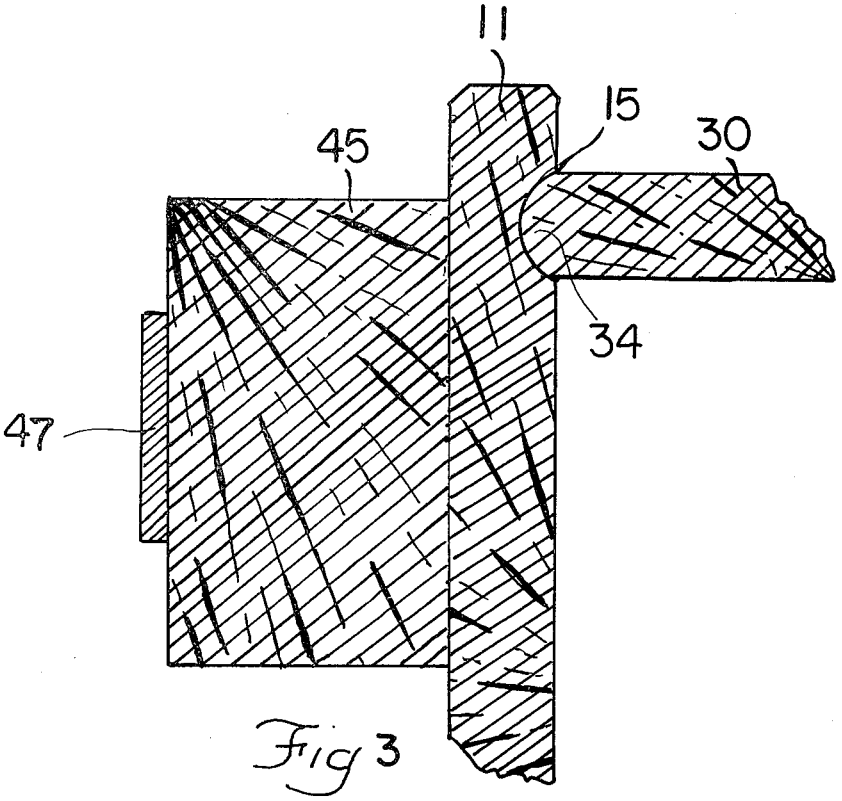
FIG. 3 is a sectional view taken on line 3—3 of FIG. 2, illustrating the relationship of the head stave engaged in the croze of the wall section, and the relationship of the external bumper and metal strap thereto.

Referring now to the drawings, the finished barrel is designated by B. The barrel consists of four wall sections 10 fabricated of white oak staves 11 of uniform dimensions. Normally, the white oak staves have a width in the range of 3–5 inches and a thickness in the range of from about $\frac{3}{4}$ to $1\frac{1}{4}$ inches. A particular advantage of the present invention is that these staves can be mass produced by well-known methods, rather than being hand-made, as has been previously practiced in the roundbarrel coopers' art. Each of the staves 11 has a tongue 12 and a complementary groove 13. Additionally, there is a croze 15 located at the top and at the bottom of each of the staves 11. The barrel also contains four triangular corner members 20, having an apex 21, two legs 22, and a base 23. The junction between leg 22 and the base 23 is truncated to form a planar portion 24 equal in width to one of the wall stave sections 11. A tongue 25 extends along the edge of one of the truncated planar portions 24 and a corresponding groove 26 extends along the edge of the other truncated planar portion. The head section of the barrel 30 is made up of head staves 31, again, of uniform dimensions, and again, each containing a tongue 32 on one edge and a corresponding groove 33 on the other. Each of the ends 34 of the head staves 31 are shaped so as to fit snugly into the croze 15 of the wall staves 11 of the wall section 10. The two lateral edge head staves 35 are shaped on one edge 36 to fit the croze of the staves 11 forming the wall section 10 and are sawn 37 at about 45°, and again shaped to fit into the croze 27 on the base portion of the triangular corner member. One of these lateral edge head staves 35 contains a projecting tongue 32 to fit into a corresponding groove 33 of an adjacent head stave and the other lateral edge head stave contains a corresponding groove to engage with the projecting tongue of an adjacent head stave. Both of these edge head staves, however, are shaped along one edge 36 so as to fit snugly into the croze 15 formed by the staves 11 of the wall section 10.

Externally of the rectangular barrel are located four bumper bars 45 which extend across the width of a wall section 10 and across the width of two corner members 20. Each of the bars has tapered ends 46 and is encircled with a metal compression strap 47. Application of pressure to the metal compression strap, therefore, applies pressure to the apex 21 of the corner member and additionally, to the side wall sections 10, to bring the individual staves into tongue-and-groove engagement. The forces acting upon the corner member 20 by reason of pressure applied by the metal compression strap 47 are S, which resolves itself at right angles as S-1 and S-2, so as to be in line with the tongue 12 and the groove 13 of the staves 11 forming the wall section 10. Therefore, by application of pressure to the apex 21 of the triangular corner member 20, the entire triangular member and the wall sections can be brought into tight tongue-and-groove engagement and the head staves 31 and 35 can be brought into tight engagement with the croze 15 of the wall stave section 10 and the croze 27 of the triangular corner member sections 20 to produce a watertight fit. The pressure of the whiskey W from the inside is also indicated and the expansion of the wooden stabes 11 due to swelling of the wooden staves is illustrated as E. It will be noted that all of these forces tend to cooperate in forming a watertight tongue-and-groove compression fit of the staves together without the use of adhesives or bonding agents.

Figure 4:
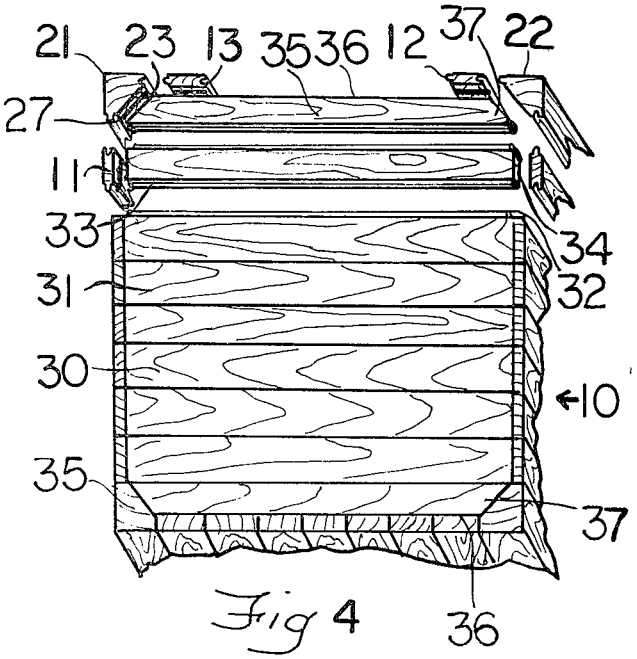
FIG. 4 is a fragmentary, partially exploded, perspective view of the rectangular barrel illustrating the steps of its construction.
Figures 5, 6:
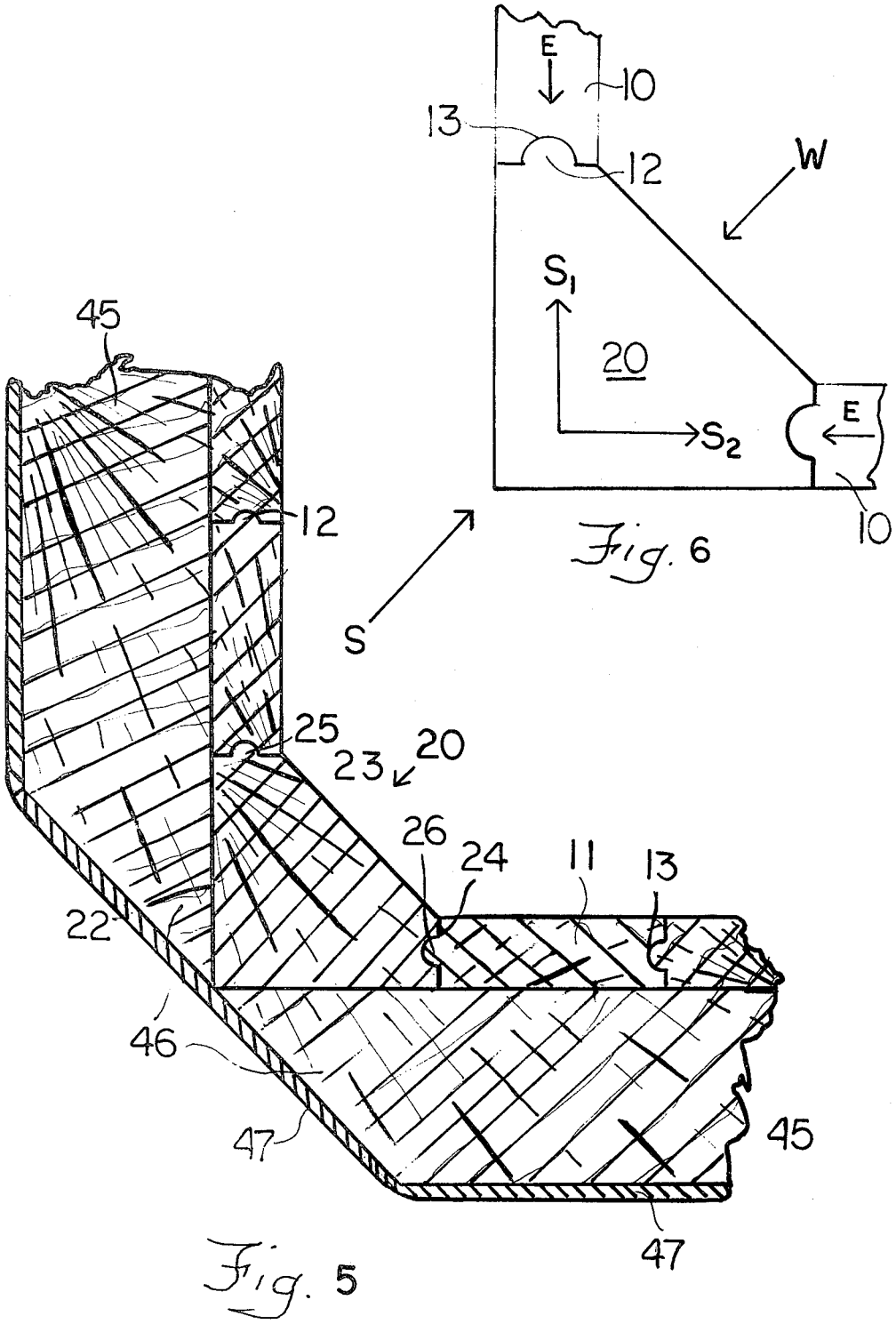
FIG. 5 is a fragmentary sectional view taken along line 5—5 of FIG. 1.
FIG. 6 is a fragmentary view in the form of a vector diagram illustrating the direction and general magnitude of the forces which tend to hold the staves and corner members in watertight tongue-and-groove engagement.

Additionally, as has been previously mentioned, it is not necessary to hand-make each stave and assemble them by skilled craftsmen as has been the practice in the past. The barrels can be produced by mass production in a much more economical way than has previously been known in this art. FIG. 4 illustrates the steps of producing a barrel of this invention. As will be noted, two of the corner members 20 are engaged with three wall sections 10. Additionally, the edge head stave 35 is fitted into the croze 27 of the corner members 20 and into the croze 15 formed by the wall staves 11. Thereafter, each of the head staves 35 at either end is fitted so that its shaped ends 34 fit into the croze 15 formed by the two wall sections 10. The remaining two corner members 20 are fitted with the remaining wall section 10 and the staves are placed into position. Thereafter, the next-to-the last head stave 31 is fitted into position and the edge head stave 35 is fitted so that the angularly sawn ends 37 fit into the croze 27 of the remaining two triangular corner members 20. Once this has been accomplished, the entire remaining wall section can be brought into engagement with the three wall sections already assembled and the bumper bars 45 placed into position for application of the metal compression strap 47. Thereafter, pressure is applied as previously mentioned, so that the vector forces are translated at right angles from the apex 21 of the triangular member, thus pulling the tongue-and-groove of the corner member 20 and the tongue-and-groove of the wall staves 11 into close, watertight engagement. By the same token, the head staves 35 are pulled into tight engagement with the croze 15 of the wall section 10 and the croze 27 of the triangular corner members 20 to produce a watertight rectangular container.

Many modifications will occur to those skilled in the art from the detailed description hereinabove given, which is meant to be exemplary in nature and non-limiting, except so as to be commensurate in scope with the appended claims.

I claim:

1. A rectangular barrel-like container, adapted for the aging of whiskey and other alcoholic beverages, which comprises, in combination:

A. head and side wall stave sections made from wooden oak staves;
1. said staves having substantially planar surfaces and being of uniform width from top to bottom and from stave to stave,
2. each of said staves having a tongue on one edge and a groove on the other edge for engaging with the groove or with the tongue of an adjacent stave,
3. the staves forming the wall having a croze at opposite ends and a body portion, which has a straight longitudinal axis and is of uniform length,
4. the staves forming the head having shaped ends, adapted to fit into the croze formed by staves forming the walls,
5. said head staves being of uniform length and width;

B. four corner members,
1. each of said corner members being in the form of a triangle, when viewed in cross section, and having an apex, legs and a base,
2. each of said corner members having been sawn from white oak bolts,
3. each of said corner members being truncated at the junction of each of the legs of said triangle with the base of said triangle, and
4. the base of said triangle forming a planar section, running the length of said member;
a. one of said truncated edges having a tongue running its length and the other of said truncated edges having a complementary groove running its length,
b. each of said four corner members having a croze at the top and bottom in the base of the triangle in the planar surface thereof;

C. at least two sets of bumper and compression members, in which each set comprises:
1. four flat bars, each bar:
a. being equal in length to the width of one wall section,
b. being tapered at each end to fit flush with the apex of said triangular corner member,
c. and being adapted for transverse mounting across the side of a wall section in proximity to the croze,
2. a metal compression strap surrounding each set of said four flat bars and the apex of each of said triangular corner members,
3. wherein application of tension to said compression strap pulls the wall sections and the head sections into compressive, water-tight, tongue-and-groove engagement.

2. A rectangular barrel-like container, as defined in claim 1, in which each stave has a width in the range of from 3–5 inches and has a thickness in the range of from about $\frac{3}{4}$ to $1\frac{1}{4}$ inches.

3. A rectangular barrel-like container, as defined in claim 1, in which the wooden oak staves are quarter-sawn from white oak bolts.

4. A rectangular barrel-like container, as defined in claim 1, the further combination therewith of an additional bumper and compression member, comprising four flat bars mounted transversely around the middle portion of said wall sections, each bar being tapered at each end so as to fit flush with the apex of the triangular corner member, and a metal compression strap surrounding said four flat bars and said triangular corner members and tensioned into a compressive water-tight engagement.

5. A rectangular barrel-like container, as defined in claim 1, in whch at least two of each set of head staves are sawn angularly at an angle of about 45° at each end and shaped to fit into the croze of the corner members and which are shaped on one edge so as to fit into the croze of the wall section staves and which contains on the other edge either a tongue or a groove for engagement with an adjacent head stave.

6. A corner construction for use with a side wall stave section in making rectangular barrel-like containers, comprising:

A. a triangular corner member, forming a triangle in cross section, but truncated at the juncture of each of the legs of the triangle with the base of the triangle so as to form five planar sections extending the length of said corner member,
1. one of said truncated edges of said corner member having a tongue running its entire length for engagement with a side wall section,
2. the other of said truncated edges having a groove running its length for engagement with a projecting tongue of a stave forming part of said side wall section;

B. tensioning means in operative relation with the apex of said triangle of said triangular member comprising:
1. external bumper members with tapered ends, and
2. a metal compression strap surrounding said external bumper members and in operative relation with the apex of said triangular corner member,
3. whereby tension applied to said strap, and to the apex of said corner triangular member, is translated to forces extending at right angles so as to apply pressure to the tongue and groove engagement of the triangular member with the staves forming the side wall section.

7. A corner construction, as defined in claim 6, in which:

A. said triangular corner member has a croze at each end for engagement with a stave of the head section of tongue-and-groove construction made of wooden oak staves of uniform dimensions;

B. said staves being sawn at about 45° at each end and shaped to fit into the croze of said triangular member.

8. A method of fabricating a rectangular barrel-like container for the aging of whiskey, which comprises:

A. forming a series of oak staves, each of uniform diameter relative to each other and each having a projecting tongue on one edge, a complementary groove on the other edge, and a croze at either end;

B. fitting said staves together to form four wall sections;

C. forming four corner members in the shape of a triangle, when viewed in cross section, each of said triangular-shaped corner members being truncated at the junction of the leg of the triangle and at the base thereof, and each containing a croze on the base portion at either end, one leg of each triangular member containing a projecting tongue and the other leg containing a complementary groove;

D. forming a series of head staves of oak, each of said head staves being of uniform dimension, and each having a projecting tongue on one edge and a complementary groove on the other edge, the ends of each of said head staves being shaped for snug engagement with the croze of the wall section,
1. forming four head staves of uniform length to the length of the other head staves, but having each end sawn at an angle and shaped for snug engagement with the croze of one of said corner members and having one edge shaped for snug engagement with the croze of the assembled wall stave section and the other edge equipped either with a projecting tongue or a complementary groove;

E. forming a series of bumper members, the length of the width of the assembled wall stave section and tapered at each end to fit flush with the apex of said triangular shaped corner members;

F. providing two metal tensioning straps, slightly greater in length to the circumference of the rectangular container;

G. fitting three assembled wall stave sections into two of the triangular corner members;

H. fitting one assembled wall stave section in tongue and groove engagement with the remaining two corner members;

I. engaging the shaped edge of two of the four head staves, having angular and shaped ends, into the croze of one wall section and the croze of the two triangular members, both top and bottom;

J. engaging the head staves in tongue-and-groove engagement with each other and with their shaped ends in snug engagement with the croze of the two wall sections, top and bottom;

K. engaging the remaining two wall staves with the finished edge and angular and shaped ends into the croze of the remaining two triangular corner members, top and bottom and into snug engagement with the croze of the remaining wall stave sections, at both top and bottom;

L. arranging four bumper members across the four wall stave sections, top and bottom in a flush fit with the apices of said triangular corner members; and M. encircling said arranged bumper members and apices of said triangular corner members with a metal tensioning strap and applying tension to pull all of the sections and the corner members into water-tight tongue-and-groove engagement.

* * * * *